US005212528A

United States Patent [19]

Matsuda

[11] Patent Number: 5,212,528

[45] Date of Patent: May 18, 1993

[54] FIXING DEVICE AND METHOD WHICH USES A HEAT DISSIPATING ROLLER HAVING FINS

[75] Inventor: Yasuhiko Matsuda, Hanamaki, Japan

[73] Assignee: Sato Corporation, Japan

[21] Appl. No.: 788,198

[22] Filed: Nov. 5, 1991

[30] Foreign Application Priority Data

Nov. 7, 1990 [JP] Japan ..... 2-302269

[51] Int. Cl.[5] ..... G03G 15/20

[52] U.S. Cl. ..... 355/285; 165/89; 219/216; 355/295

[58] Field of Search ..... 355/282, 285, 290, 295, 355/289, 291; 219/216, 469; 432/60; 165/89

[56] References Cited

U.S. PATENT DOCUMENTS

| | | | |
|---|---|---|---|
| 4,963,942 | 10/1990 | Aoki | 355/290 |
| 4,963,943 | 10/1990 | Tamary | 355/290 |
| 5,032,875 | 7/1991 | Gooray et al. | 355/290 |
| 5,070,231 | 12/1991 | Bacus et al. | 219/216 |

FOREIGN PATENT DOCUMENTS

| | | | |
|---|---|---|---|
| 0085577 | 4/1988 | Japan | 355/282 |
| 0102591 | 4/1989 | Japan | 355/285 |
| 0121883 | 5/1989 | Japan | 355/285 |

*Primary Examiner*—A. T. Grimley
*Assistant Examiner*—William J. Royer
*Attorney, Agent, or Firm*—Ostrolenk, Faber, Gerb & Soffen

[57] ABSTRACT

A thermal toner fixing device for a xerographic apparatus comprises a heat dissipation mechanism for dissipating heat accumulating in a pressure roller rotating in contact with a heat roller so as to achieve substantially uniform thermal deformation throughout the pressure roller and, as a result, uniform contact with the heat roller irrespective of the width of the paper sheet being conveyed. The device enables both wide and narrow sheets of paper to be properly conveyed with high reliability. Preferably, the heat dissipation mechanism is a heat dissipation roller in contact with the pressure roller, and the heat dissipation roller has a substantially hollow interior for the passage of circulating cooling air.

4 Claims, 3 Drawing Sheets

FIXING DEVICE AND METHOD WHICH USES A HEAT DISSIPATING ROLLER HAVING FINS

BACKGROUND OF THE INVENTION

The present invention relates to a thermal toner fixing device for a xerographic apparatus.

In most xerographic apparatus, the surface of an electrostatically charged photosensitive drum is exposed to image carrying light to form a latent image thereon, toner is adhered to the latent image to develop it, and the toner image is transferred to a sheet of paper and fixed thereon.

The toner fixing operation in this process is commonly conducted using a thermal toner fixing device like the one shown in FIG. 3. This device has a heat roller 2 rotatably supported on a shaft 1 and heated by an appropriate heat source to a temperature of around 180° C., and a silicon rubber pressure roller 5 supported on a shaft 4. The surface 3 of the heat roller 2 and the surface 6 of the pressure roller 5 are forced against each other at a prescribed pressure. When a sheet of paper 7 bearing a toner image is inserted between the rollers 2 and 5 and the rollers are independently rotated for passing the sheet therebetween, the toner is melted and fixed to the paper by the heat of the heat roller 2.

When a sheet of paper 7 that is narrower than the width (lateral length) of the heat roller 2 is passed between the rollers, the pressure roller 5 absorbs more heat at the portions where the paper is not present than at the portions where it is. The temperature at the surface of the pressure roller 5 therefore rises to around 180° C. at portions where it is in direct contact with the heat roller 2, as compared with only around 50° C. at portions where it indirectly contacts the heat roller 2 through the paper.

The diameter of the pressure roller 5 at the portions on opposite sides of the paper 7 therefore increases considerably owing to thermal expansion. As a result, the heat roller 2 is pushed upward, with the non-uniform heating producing an inclined step 8 (exaggerated in the figure for clarity) in the pressure roller 5 on either side of the portion in contact with the paper 7 and a gap 9 between the surface 3 of the heat roller 2 and the surface 6 of the pressure roller 5 at the portion where the paper is present. This is apt to give rise to slippage between the paper 7 and the rotating heat and pressure rollers so that the paper 7 is liable to be improperly conveyed and may jam.

OBJECTS AND SUMMARY OF THE INVENTION

It is an object of the present invention to provide a thermal toner fixing device for a xerographic apparatus in which heat accumulating in the pressure roller is dissipated so as to achieve uniform thermal deformation throughout the pressure roller and thus enable both wide and narrow sheets of paper to be conveyed accurately and quickly.

For realizing this object, the mechanism according to this invention provides a thermal toner fixing device for a xerographic apparatus equipped with a heat dissipation mechanism for dissipating heat accumulating in the pressure roller.

In the thermal toner fixing device for a xerographic apparatus according to the invention, since heat accumulating in the pressure roller is dissipated by the heat dissipation mechanism, non-uniform heat deformation of the pressure roller is prevented and the surface temperature of the pressure roller becomes relatively even throughout.

Since the whole surface of the pressure roller is therefore pressed onto the surface of the heat roller at the prescribed pressure, sheets of paper can be conveyed accurately and quickly by the rotation of the heat and pressure rollers without slipping or jamming.

Other features and advantages of the present invention will become apparent from the following description of the invention which refers to the accompanying drawings.

DETAILED DESCRIPTION OF THE DRAWINGS

Figure 1:
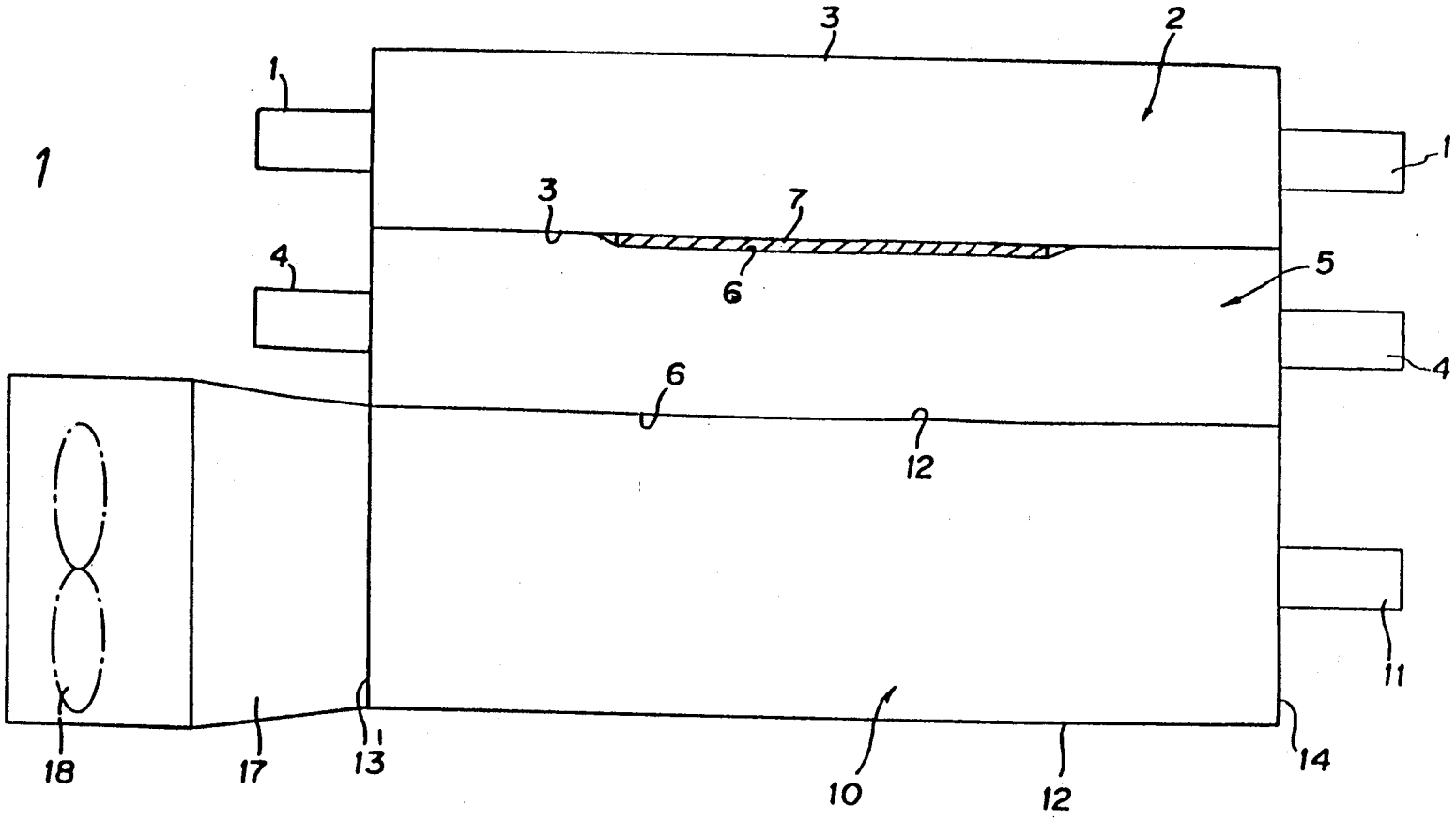
FIG. 1 is a schematic front view of a thermal toner fixing device according to the invention.

The invention will now be explained with reference to an embodiment thereof shown in FIGS. 1 and 2. The constituent elements of this embodiment corresponding to those of the conventional device described above are assigned the same reference numerals as in the earlier description and will not be explained here again.

In the figures, reference numeral 10 designates a hollow aluminum heat dissipation drum or roller (heat absorbing roller) rotatably supported on a shaft 11 at an appropriate location in a xerographic apparatus (not shown).

Figure 2:
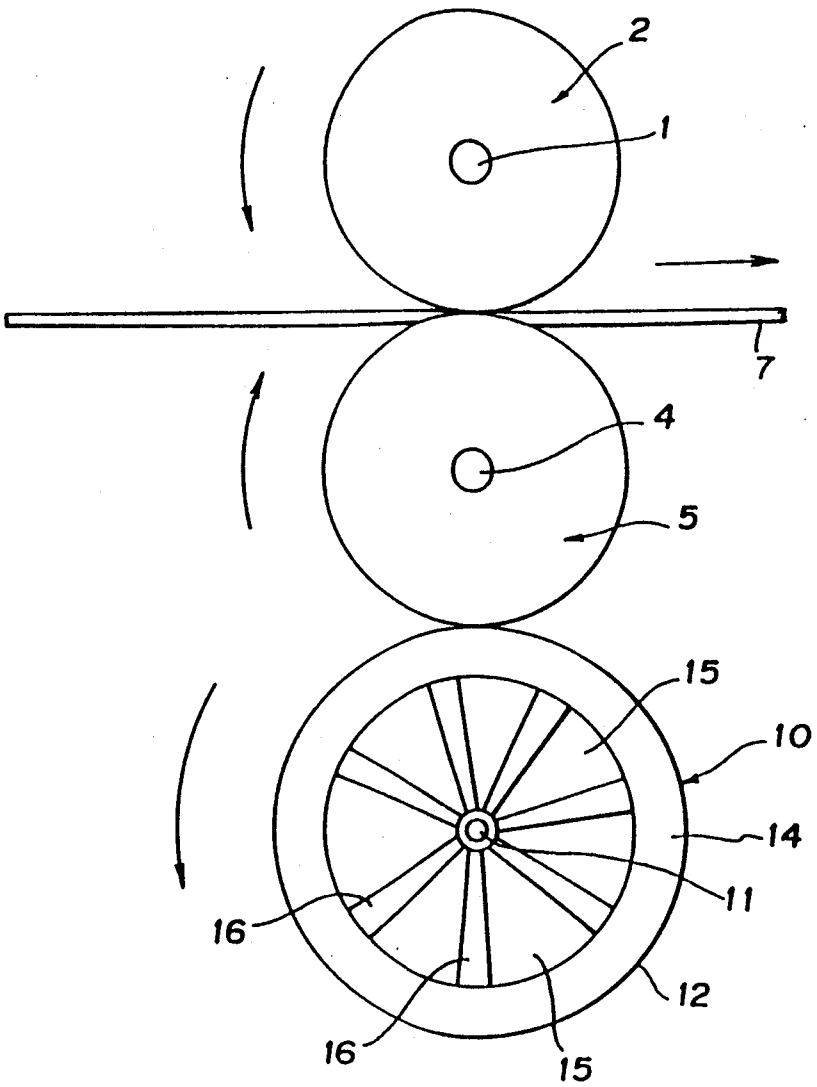
FIG. 2 is a schematic side view of the thermal toner fixing device of FIG. 1.

The upper part of the surface 12 of the heat dissipation drum 10 is pressed onto the surface 6 of the pressure roller 5 at a prescribed pressure, whereby it absorbs heat by conduction from the pressure roller 5 and rotates in the direction indicated by an arrow in FIG. 2 when the pressure roller 5 rotates in the direction indicated by another arrow. The heat dissipation drum 10 is open at both lateral ends 13 and 14 and substantially hollow. A plurality of equiangularly spaced heat dissipation fins 16 extend radially between a central hub surrounding the shaft 11 at the center of the hollow interior 15 of the heat dissipation drum 10 and the inner surface of the drum 10.

The heat absorbed by the heat dissipation drum 10 from the pressure roller 5 is thus dissipated both through the portions of its surface 12 not in contact with the pressure roller and through the heat dissipation fins 16 into the hollow interior 15.

A duct 17 provided in communication with the end 13 of the heat dissipation drum 10 is provided internally with a rotating fan 18 powered by a motor not shown in the figures.

An air stream generated by the rotation of the fan 18 passes from the end 13, through the hollow drum interior 15 and out the other end 14, carrying with it the air within the hollow interior 15 that has been warmed by the heat dissipated by the fins 16.

The operation of the thermal toner fixing device made in the foregoing manner will now be explained.

When a narrow piece of paper 7 of a width smaller than that of the pressure roller 5 is passed between the pressure roller 5 and the heat roller 2, high temperature heat is directly conducted from the heat roller 2 to the portions of the pressure roller 5 on the opposite sides of the paper 7, while high temperature heat is also conducted from the heat roller 2 to the center region of the pressure roller 5 through the paper 7.

This heat is thereafter conducted from the pressure roller 5 to the heat dissipation drum 10 rotating in contact therewith and is dissipated both from the surface 12 of the heat dissipation drum 10 and from the heat dissipation fins 16 into the hollow interior 15.

The air in the hollow interior 15 warmed by the heat from the fins 16 is then blown by the fan 18 from the end 13 of the heat dissipation drum 10, through the hollow interior 15 and to the outside through the other end 14. The hollow interior 15 of the heat dissipation drum 10 is therefore cooled, thereby promoting the dissipation of heat from the fins 16 and, in turn, the absorption of heat by the heat dissipation drum 10 from the pressure roller 5. As a result, the opposite end regions of the pressure roller 5 are prevented from rising to a high temperature and, therefore, from experiencing undue thermal expansion.

In addition, the movement of the hot air in the hollow interior 15 of the heat dissipation drum 10 by the fan 18 warms the central region of the heat dissipation drum 10, which is at a lower temperature than the regions toward the ends 13 and 14, and this in turn warms the central portion of the pressure roller 5 in contact with the central portion of the heat dissipation drum 10 and causes it to undergo thermal expansion.

As a consequence, the heat distribution becomes substantially uniform across the full width of the pressure roller 5, the amount of its thermal expansion in the radial direction becomes substantially constant throughout, the surface 6 of the pressure roller 5 and the surface 3 of the heat roller 2 press onto each other at the prescribed pressure, and the paper 7 is reliably conveyed.

Figure 3:
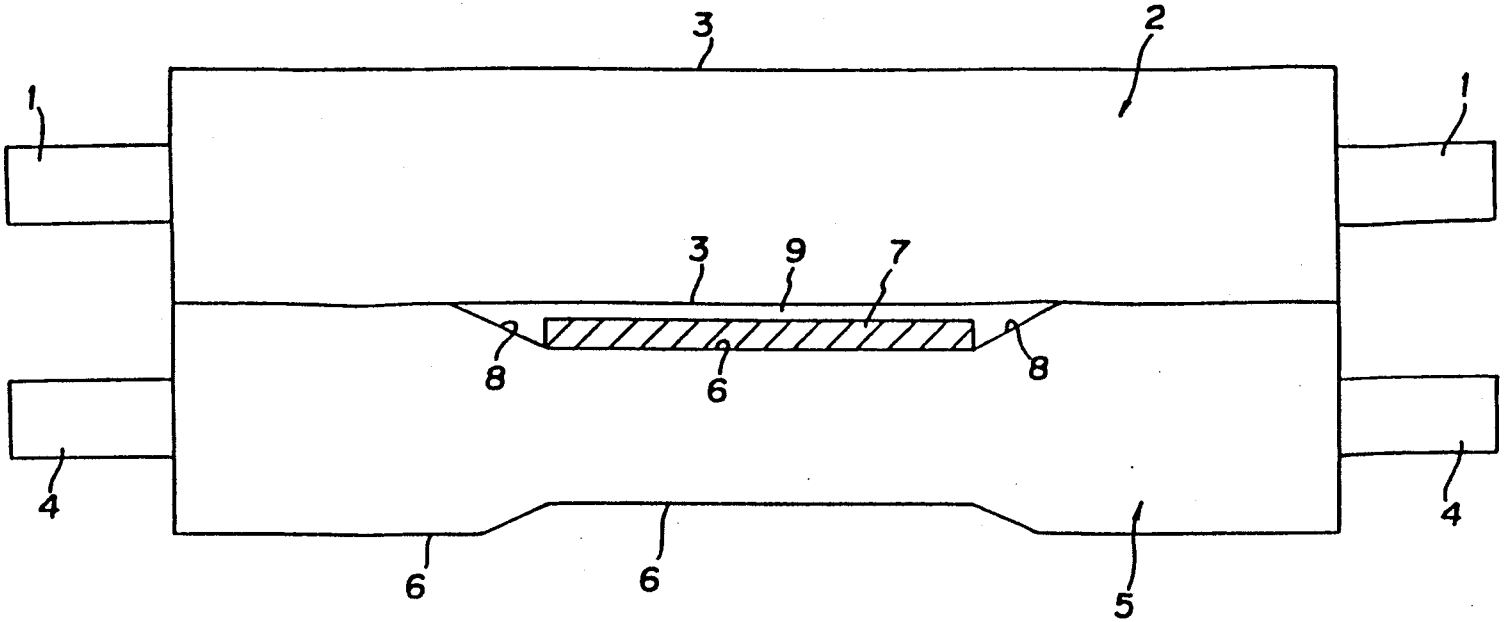
Fig. 3 PRIOR ART
FIG. 3 is a schematic front view of a conventional thermal toner fixing device.

As shown in FIG. 1, a small step is shown in the surface of the pressure roller 5 adjacent the heat roller 2. The step is minimal, and only shown exaggerated for purposes of clarity. The step shown in the pressure roller of FIG. 1 is much smaller than that shown in FIG. 3, where no heat dissipating device in accordance with the invention is used. Additionally, no step is shown at the lower surface of the pressure roller 5 in FIG. 1 adjacent the heat dissipation drum, as the heat dissipation drum has substantially dissipated the heat at the lower surface so that the surface is practically uniform at this point. In any event, the small step shown at the upper surface of the pressure roller 5 does not interfere with proper conveyance of the paper 7 or the maintenance of proper pressure between the heat roller and the pressure roller.

When a wide sheet of paper 7 is conveyed through the rollers, the surface 3 of the heat roller 2 and the surface 6 of the pressure roller 5 contact each other through the paper at all portions, and the heating of the pressure roller 5 is substantially uniform so that the heat dissipation drum helps in cooling the pressure roller 5 evenly. The effect of this contact is deemed obvious from the foregoing explanation, and need not be discussed in further detail here.

Since the present invention provides a heat dissipation mechanism for dissipating heat accumulating in the pressure roller through contact with the heat roller, the heat deformation of the pressure roller remains substantially uniform even when a sheet of paper that is narrower than the width of the heat roller is passed between the heat and pressure rollers. As a result, the pressure roller and the heat roller do not separate but are pressed against each other at the prescribed pressure via the paper being conveyed, whereby the paper can be reliably conveyed in the proper manner.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. In a thermal toner fixing device for a xerographic apparatus which fixes a toner image to a sheet of paper having the toner image disposed thereon by heating the sheet of paper as it is passed between a rotatable heat roller and a rotatable pressure roller in contact with the heat roller, heat dissipation means for dissipating heat accumulating in the pressure roller and for maintaining heat deformation of the pressure roller substantially uniform, the heat dissipation means comprising a heat absorbing roller in contact with the pressure roller for dissipating heat absorbed by the pressure roller from the heat roller, the heat absorbing roller including a substantially hollow interior, a central hub, a cylindrical roller surface disposed radially outward from said hub, an inner surface facing said hub, and a plurality of substantially equiangularly spaced heat dissipation fins disposed in the hollow interior and extending radially between the hub and the inner surface for connecting said hub to said cylindrical surface and for dissipating heat absorbed by the cylindrical surface into the hollow interior, and further comprising a cooling fan for circulating air and removing heat from said hollow interior.

2. A thermal toner fixing device for a xerographic apparatus which fixes a toner image previously deposited on a sheet of paper to the sheet of paper by heating the sheet of paper as it is passed through the toner fixing device, the device comprising a rotatable heating roller and a rotatable pressure roller in contact with the heating roller, and further comprising heat dissipation means for absorbing heat from said pressure roller and for maintaining heating of the pressure roller substantially uniform across the surface of the pressure roller, the heat dissipation means comprising a heat absorbing roller in contact with the pressure roller for dissipating heat absorbed by the pressure roller from the heating roller, the heat absorbing roller including a substantially hollow interior, a central hub, a cylindrical roller surface disposed radially outward from said hub, an inner surface facing said hub, and a plurality of substantially equiangularly spaced heat dissipation fins disposed in the hollow interior and extending radially between the hub and the inner surface for connecting said hub to said cylindrical surface and for dissipating heat absorbed by the cylindrical surface into the hollow interior, and further comprising a cooling fan for circulating air and for removing heat from said hollow interior.

3. A method for cooling a pressure roller in a thermal toner fixing device of a xerographic apparatus wherein a sheet of paper having a toner image previously deposited thereon is fixed to the sheet of paper as the sheet of paper passes between a heating roller and the pressure roller, the method comprising a step of dissipating heat absorbed by said pressure roller from said heating roller so as to remove excess heat accumulating in areas of said pressure roller and maintain heating of said pressure roller substantially uniform, said step of dissipating heat comprising a step of providing a heat dissipating roller having a substantially hollow interior and a plurality of substantially equiangularly spaced heat dissipation fins extending radially between a hub of said heat dissipating roller and an inner surface of said heat dissipating roller and said heat dissipating roller being in contact with said pressure roller for absorbing heat from said pressure roller, said step of providing a heat dissipating roller in contact with said pressure roller further comprising a step of circulating cooling air through the substantially hollow interior of said heat dissipating roller.

4. Apparatus for preventing jamming and for allowing proper conveyance of a sheet of paper between a heating roller and a pressure roller in a thermal toner fixing station of a xerographic apparatus, the sheet of paper having a toner image to be fixed deposited thereon, the apparatus comprising heat absorption means in contact with the pressure roller for absorbing heat accumulating in the pressure roller and for maintaining heating of the pressure roller substantially uniform across the surface of the pressure roller and for preventing non-uniform heating of the pressure roller, the heat absorption means comprising a heat dissipating roller having an outer surface in contact with the pressure roller, an interior of the heat dissipating roller being substantially hollow for passage of cooling air, the heat dissipating roller having a plurality of substantially equiangularly spaced heat dissipating fins in the substantially hollow interior, the fins extending radially between a central hub of said heat dissipating roller and an inner cylindrical surface of said heat dissipating roller adjacent the outer surface of the heat dissipating roller.

* * * * *